US007766421B2

(12) United States Patent
Lawson

(10) Patent No.: US 7,766,421 B2
(45) Date of Patent: Aug. 3, 2010

(54) RECLINER LIFT CHAIR WITH POWER LIFT AND RECLINING UNITS

(75) Inventor: Greg Lawson, Tupelo, MS (US)

(73) Assignee: L & P Property Management Company, Sourh Gate, CA (US)

( * ) Notice: Subject to any disclaimer, the term of this patent is extended or adjusted under 35 U.S.C. 154(b) by 237 days.

(21) Appl. No.: 11/954,277

(22) Filed: Dec. 12, 2007

(65) Prior Publication Data

US 2008/0150329 A1 Jun. 26, 2008

Related U.S. Application Data

(60) Provisional application No. 60/876,250, filed on Dec. 21, 2006.

(51) Int. Cl.
*A47C 1/02* (2006.01)

(52) U.S. Cl. ..... 297/85 R; 297/84; 297/85 M

(58) Field of Classification Search ..... 297/DIG. 10, 297/85 R, 85 M
See application file for complete search history.

(56) References Cited

U.S. PATENT DOCUMENTS 3,596,982 A * 8/1971 Grams ..... 297/71
4,083,599 A * 4/1978 Gaffney ..... 297/131
4,637,652 A * 1/1987 Bergenwall ..... 297/90
4,722,566 A * 2/1988 Castellini ..... 297/68
5,312,153 A * 5/1994 Lin ..... 297/89
5,730,494 A * 3/1998 LaPointe et al. ..... 297/330
5,865,457 A 2/1999 Knabusch et al.
5,868,461 A 2/1999 Brotherston
6,154,899 A 12/2000 Brooke et al.
6,840,575 B2 * 1/2005 Hesse ..... 297/85 M
7,575,279 B2 * 8/2009 Robertson ..... 297/330

* cited by examiner

*Primary Examiner*—Sarah B McPartlin
(74) *Attorney, Agent, or Firm*—Myers Bigel Sibley & Sajovec

(57) ABSTRACT

A lift chair includes: a base; a seat; a backrest; at least one ottoman; a lift-reclining mechanism attached to the base and to the seat; a backrest reclining mechanism coupled with the lift-reclining mechanism and attached to the seat, the backrest and the ottoman; a lift power unit attached to the base and to the lift-reclining mechanism; and a backrest reclining power unit attached to the base and to the backrest reclining mechanism. The lift-reclining mechanism is configured to move the chair between an upright position, in which the seat is generally horizontally disposed and positioned above the base at a first height and at a first pitch angle that is positive relative to horizontal, the backrest is generally upright, and the ottoman is positioned below the seat, and a lifted position, in which the seat is raised to a second height that is higher than the first height and at a second pitch angle that is negative relative to horizontal. The lift-backrest reclining mechanism is further configured to move the chair from the upright position to a TV position, in which the ottoman is generally horizontally disposed in front of the seat, and to a fully reclined position, in which the backrest is reclined relative to the seat. The backrest reclining mechanism is configured to move the chair between the TV and fully reclined positions.

12 Claims, 9 Drawing Sheets

RECLINER LIFT CHAIR WITH POWER LIFT AND RECLINING UNITS

RELATED APPLICATION

This application claims priority from U.S. Provisional Patent Application No. 60/876,250, filed Dec. 21, 2006 and entitled Recliner Lift Chair with Dual Motors, the disclosure of which is hereby incorporated herein in its entirety.

FIELD OF THE INVENTION

The present invention is directed to furniture, and more particularly to seating units for the health care industry.

BACKGROUND OF THE INVENTION

Power operated lift recliner chairs are commonly used by persons needing assistance in transferring from a seated position in a chair to a standing position includes a power operated lift mechanism which raises the chair and tilts it forwardly to bring its occupant to a standing position, and in reverse lowers the occupant from a standing to a seated position. Such chairs may also shift rearwardly to one or more reclining rest positions. U.S. Pat. Nos. 4,007,960, 4,083,599, and 4,993,777 illustrate various prior lift chairs and their operating mechanisms. Another type of chair, illustrated and described in U.S. Pat. No. 5,895,093, has a swivel unit that enables the chair to turn to the left or right toward another person or another object such as a television set.

It may be desirable to provide additional function to lift chairs that have reclining capability.

SUMMARY OF THE INVENTION

As a first aspect, embodiments of the invention are directed to a lift chair. The lift chair comprises: a base; a seat; a backrest; at least one ottoman; a lift-reclining mechanism attached to the base and to the seat; a backrest reclining mechanism coupled with the lift-reclining mechanism and attached to the seat, the backrest and the ottoman; a lift power unit attached to the base and to the lift-reclining mechanism; and a backrest reclining power unit attached to the base and to the backrest reclining mechanism. The lift-reclining mechanism is configured to move the chair between an upright position, in which the seat is generally horizontally disposed and positioned above the base at a first height and at a first pitch angle that is positive relative to horizontal, the backrest is generally upright, and the ottoman is positioned below the seat, and a lifted position, in which the seat is raised to a second height that is higher than the first height and at a second pitch angle that is negative relative to horizontal. The lift-backrest reclining mechanism is further configured to move the chair from the upright position to a TV position, in which the ottoman is generally horizontally disposed in front of the seat, and to a fully reclined position, in which the backrest is reclined relative to the seat. The backrest reclining mechanism is configured to move the chair between the TV and fully reclined positions.

As a second aspect, embodiments of the invention are directed to a lift chair, comprising: a base; a seat; a backrest; at least one ottoman; a lift-reclining mechanism attached to the base and to the seat; a backrest reclining mechanism coupled to the lift-reclining mechanism and attached to the seat, the backrest and the ottoman; a lift power unit attached to the base and to the lift-reclining mechanism; and a backrest reclining power unit attached to the base and to the backrest reclining mechanism. The lift-reclining mechanism is configured to move the chair between an upright position, in which the seat is generally horizontally disposed and positioned above the base at a first height and at a first pitch angle that is positive relative to horizontal, the backrest is generally upright, and the ottoman is positioned below the seat, and a lifted position, in which the seat is raised to a second height that is higher than the first height and at a second pitch angle that is negative relative to horizontal. The lift-reclining mechanism is further configured to move the chair from the upright position to a TV position, in which the ottoman is generally horizontally disposed in front of the seat, and to a fully reclined position, in which the backrest is reclined relative to the seat. The backrest reclining mechanism is configured to move the chair between the TV and fully reclined positions. The chair includes front and rear sets of wheels. The lift-reclining mechanism includes a seat base bracket, and wherein the front wheels are attached to the seat base bracket, such that the front wheels are lifted from the ground when the chair moves to the lift position. The seat base bracket unit rests upon the base when the chair is in the upright position.

DETAILED DESCRIPTION OF EMBODIMENTS OF THE INVENTION

Figure 1:
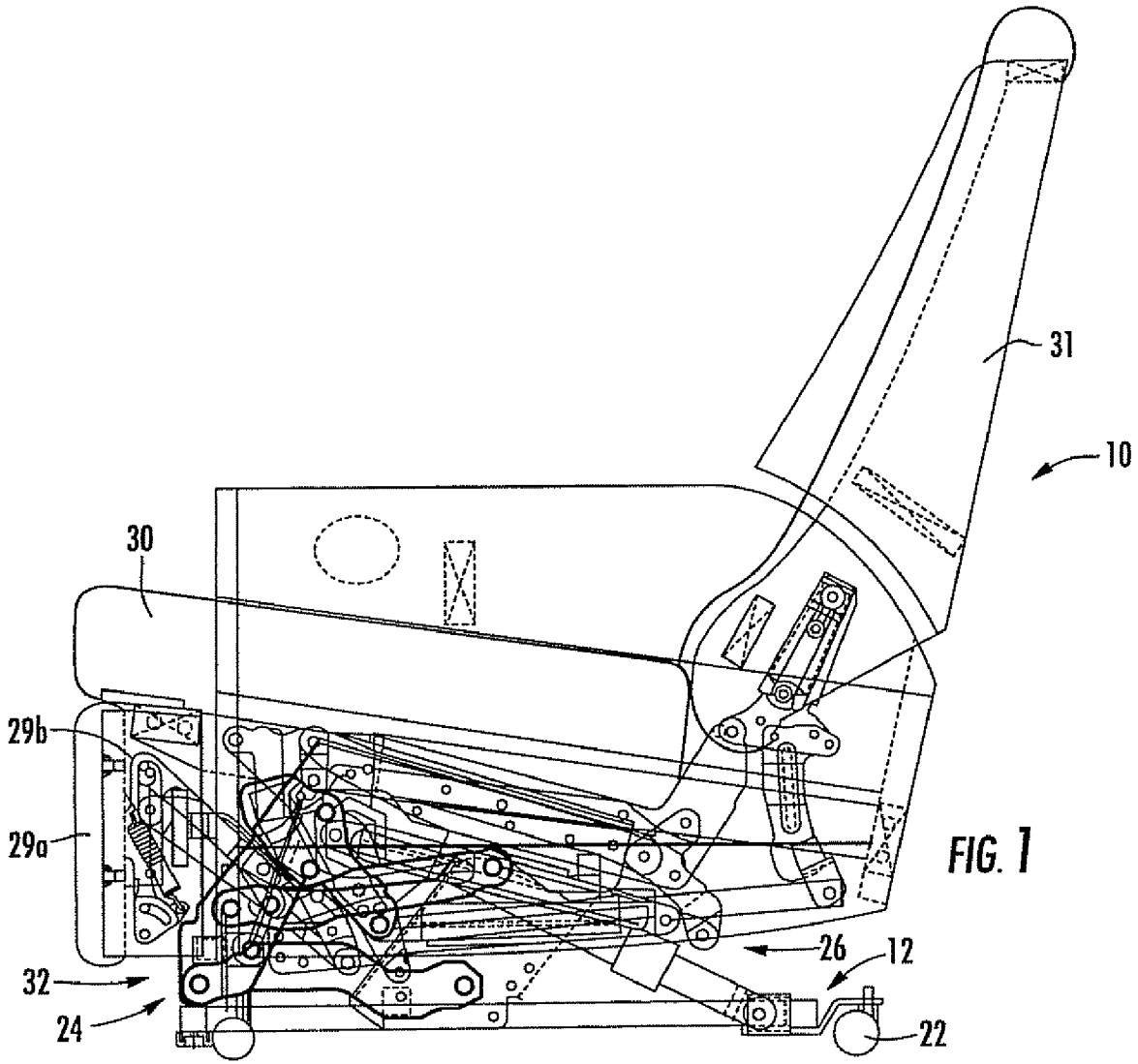
FIG. 1 is a side section view of an embodiment of a recliner chair of the present invention, with the chair shown in the upright position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating unit between its armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating unit illustrated and described herein comprises a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, FIG. 1 shows a reclining lift chair, designated broadly at 10, in its upright position. The chair 10 includes a base 12, a generally horizontally disposed seat 30 positioned above the base 12, a generally upright backrest 31, and front and intermediate ottomans 29*a*, 29*b*. These components are moveable relative to one another between a closed position (shown in FIGS. 1, 2, 5, 6 and 8), a TV position (shown in FIGS. 3 and 9), a fully reclined position (FIG. 4) and a lifted position (FIG. 7); movement between these positions is controlled by pairs of coupled mirror image lift-reclining and backrest reclining mechanisms 24, 26 shown in FIGS. 2-9. For clarity of illustration, the lift-reclining mechanism and backrest reclining mechanisms 24, 26 will be described first with respect to the upright position (best seen in FIGS. 2, 6 and 8). Subsequently, the movements of the mechanisms 24, 26 between the aforementioned positions will be described.

Because the pairs of lift-reclining and backrest reclining mechanisms 24, 26 are mirror images sets of mechanisms, only one lift-reclining mechanism 24 and one backrest reclining mechanism 26 will be described herein in detail, with the understanding that this description is equally applicable to the other lift-reclining and backrest reclining mechanisms 24, 26.

Figure 2:
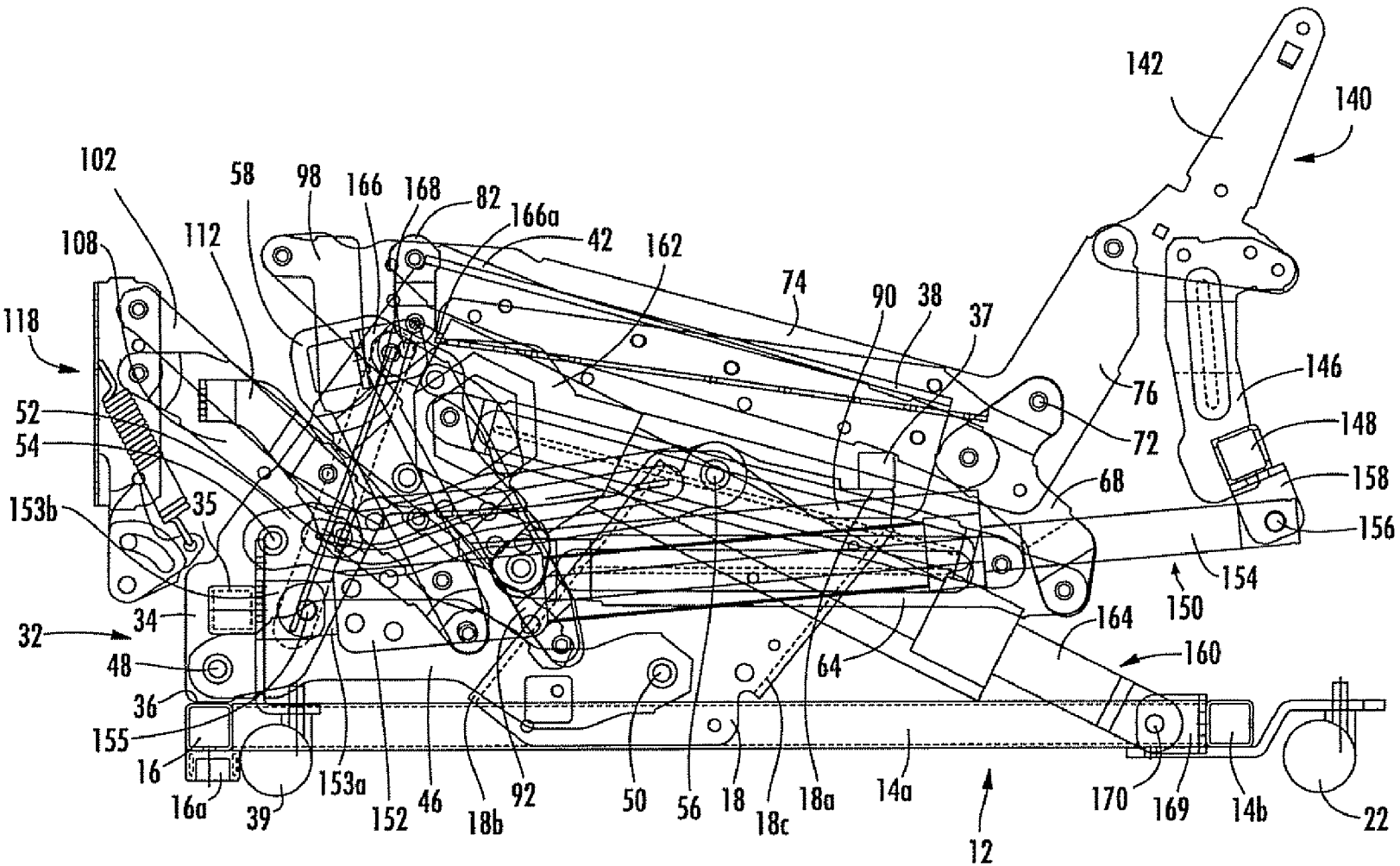
FIG. 2 is a side section view of the lift and reclining mechanisms of the chair of FIG. 1 shown in the closed position.
Figure 5:
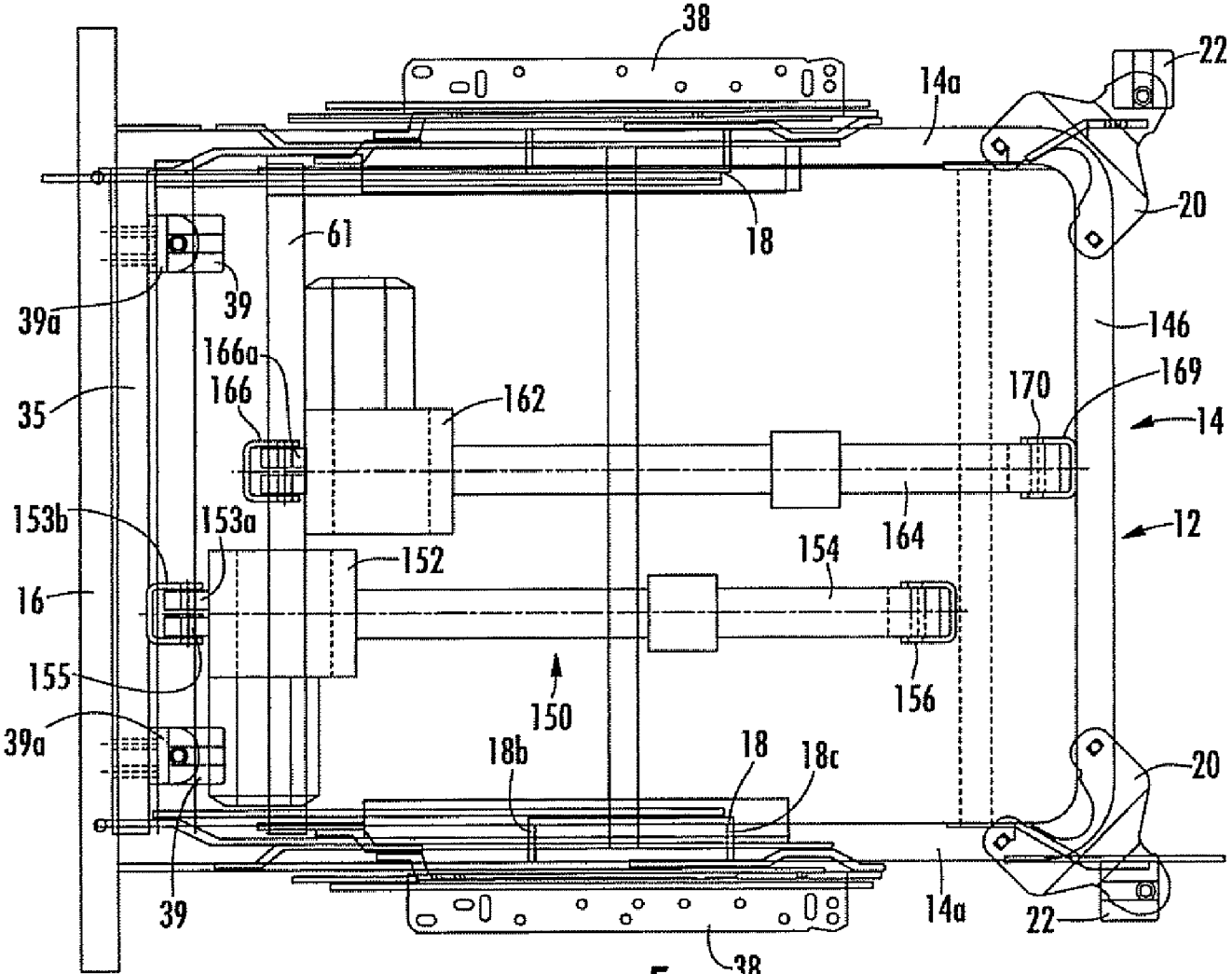
FIG. 5 is a top view of the base and lift and reclining motor units of the chair of FIG. 1 shown in the fully reclined position.

Looking now at FIGS. 1, 2 and 5, the base 12 comprises a U-shaped tube 14 with longitudinally-extending legs 14*a* and a rear cross-member 14*b*. A front base tube 16 spans the front ends of the legs 14*a*. A parallelogrammatic base bracket 18 is mounted to each the inboard surface of each of the legs 14*a*. Each base bracket 18 has an upper ledge 18*a* and front and rear flanges 18*b*, 18*c* that extend laterally. A rear caster bracket 20 is fixed to the rear portions of the legs 14*a*; a rear caster 22 extends downwardly from each rear caster bracket 20 to rest on the floor or other underlying surface.

Turning now to FIGS. 1, 2, 5 and 6, the lift-reclining mechanism 24 includes a seat base assembly 32 that is pivotally interconnected with and rests on the base 12. The seat base assembly 32 includes a seat base bracket 34 having a front lower edge 36 that, in the upright position of FIGS. 1 and 6, rests upon the upper surface of each leg 14*a*. A front cross tube 35 extends between the front end portions of the seat base bracket 34 on each side of the chair 10. A rear cross tube 37 extends between rear portions of the seat base brackets 34 and rests on the upper ledge 18*a* of the base bracket 18. Two front casters 39 are mounted to respective caster brackets 39*a* that are fixed to the rear surface of the front cross tube 35. In its central portion, the seat base bracket 34 includes an arcuate slot 40. Also, an upper flange 38 extends inwardly from the upper edge of each seat base bracket 34 to support the seat 30 from underneath. A seat link 42 is fixed to the outer surface of the seat base bracket 34.

Figure 6:
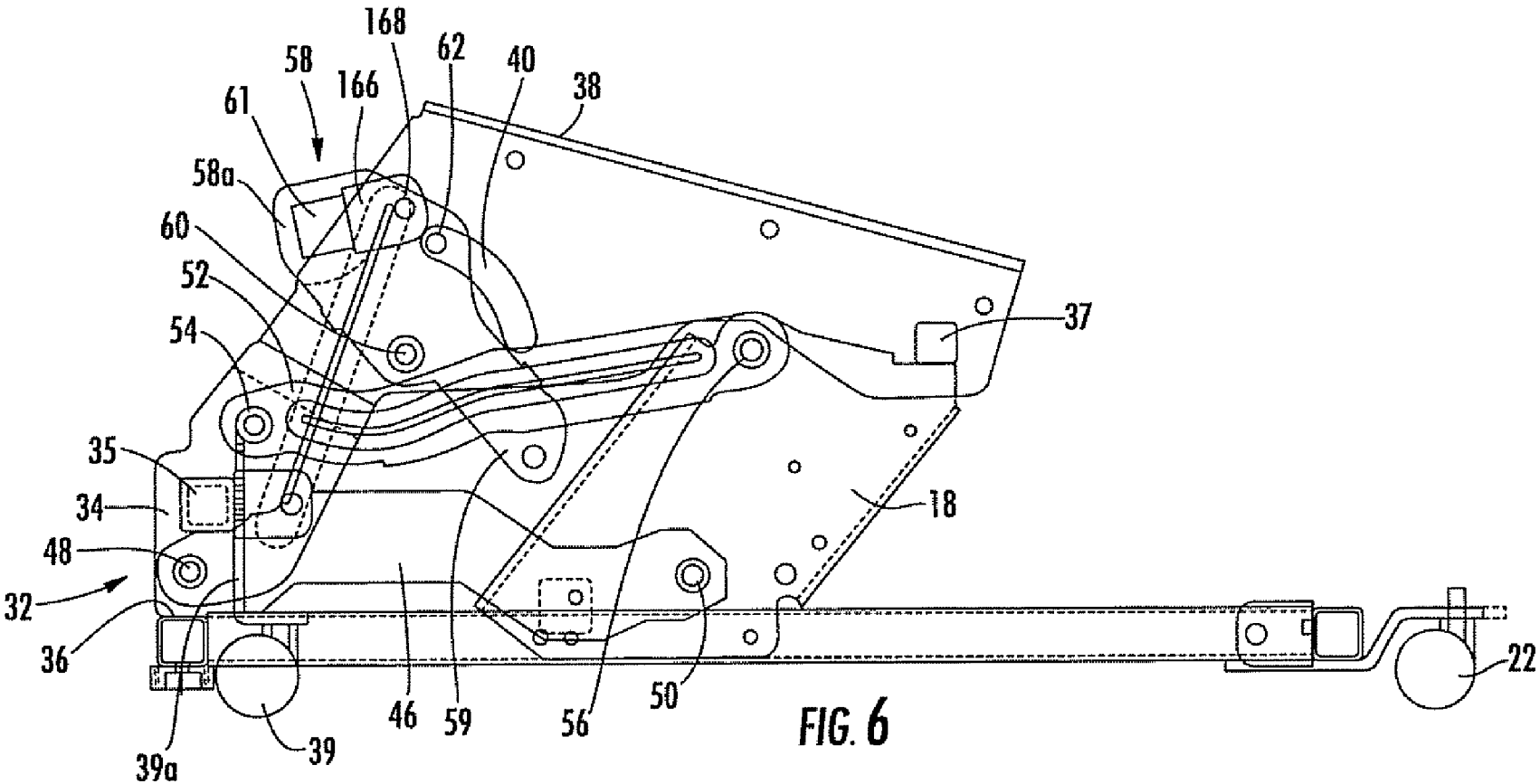
FIG. 6 is a side section view of the lift mechanism of the chair of FIG. 1 shown in the upright position.

Referring still to FIGS. 1, 2 and 6, the lift-reclining mechanism 24 also includes a lower lift swing link 46 that is pivotally attached to the lower front portion of the seat base bracket 34 at a pivot 48 and extends generally rearwardly therefrom. The lower lift swing link 46 terminates at a pivot 50 with the base bracket 18 at a pivot 52. An upper lift swing link 52 is attached to the seat base link 34 at a pivot 54 located above and slightly rearward of the pivot 48. The upper lift swing link 54 extends rearwardly and slightly upwardly to terminate in a pivot 56 with the upper portion of the base bracket 18.

A transition member 58 having a lobe 58*a* and a finger 59 extending therefrom is connected with the seat base bracket 34 at a pivot 60 that is located in the lower portion of the lobe 58*a*. In addition, a pin 62 is fixed to the opposite side of the lobe 58*a* and is received in the slot 40 of the seat base bracket 34. A cross-member 61 extends between the upper ends of lobes 58*a* on opposite sides of the chair 10. In the upright position of FIGS. 1, 2 and 6, the transition member 58 is oriented such that the lobe 58*a* is positioned forwardly and upwardly from the finger 59, and the pin 62 is at the forward, upper end of the slot 40.

Figure 7:
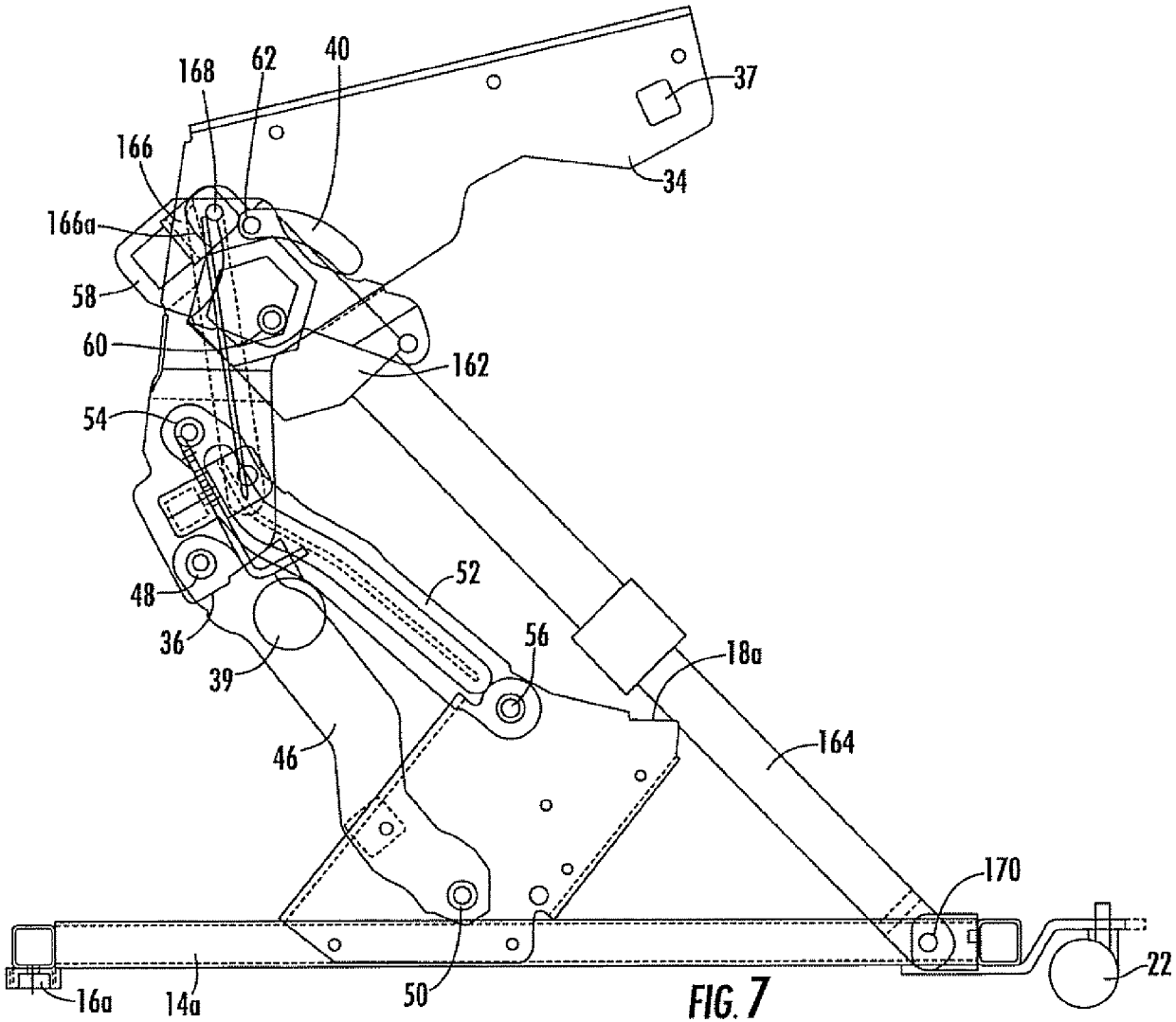
FIG. 7 is a side section view of the lift mechanism of the chair of FIG. 1 shown in the lifted position.

The aforementioned components (i.e., the seat base bracket 34, the seat link 42, the upper and lower lift swing links 46, 52 and the transition member 58) combine to control the movement of the chair between the upright position of FIGS. 1, 2 and 6 and the lift position of FIG. 7. The movement is controlled by a lift/footrest power unit 160, which includes a motor 162 and a retractable rod 164. The motor 162 includes a mounting bracket 166*a* and is pivotally mounted at a pivot 168 to a mounting bracket 166 that is fixed to the cross-member 61 that connects the lobes 58*a* of the transition members 58. The rod 164 is pivotally mounted at a pivot 170 to a mounting bracket 169 fixed to the forward surface of the rear cross-member 14*b* of the tube 14.

To move the chair 10 from its upright position (FIGS. 1, 2 and 6) to its lift position of FIG. 7, power is supplied to the power unit 160 (the power unit 160 is electrically powered via an electrical cord—not shown—and is typically activated by the occupant of the chair 10 with a button or other controller) such that the rod 164 begins to extend from the motor 162. The extension of the rod 162 applies a forwardly and upwardly directed force on the transition member 58, which urges the transition member to rotate counterclockwise (from the vantage point of FIG. 6) about the pivot 60. However, because the pin 62 is already in the upper and forward end of the slot 40, the transition member 58 is unable to rotate about the pivot 60, so the extension of the rod 164 instead drives the seat base bracket 34 upwardly and forwardly, thereby lifting the rear cross tube 37 off of the upper ledge 18*a* of the base bracket 18 and the lower front edge 36 of the seat base bracket 34 off of the front base tube 16. This action is controlled by the upper and lower lift swing links 52, 46 which pivot clockwise around, respectively, the pivots 56, 50. The relative positions of the pivots 54, 48 between the upper and lower swing links 52, 46 and the seat base bracket 34 also cause the seat base bracket 34 (and the seat 30 mounted thereon) to rotate counterclockwise relative to the underlying surface. This lifting and rotating action can assist an occupant of the seat (for example, an elderly or infirm person) in getting up and out of the chair 10. As part of this motion, the seat 30, which has a slightly positive pitch relative to horizontal in the upright position, rotates to a negative pitch in the lift position (in some embodiments, the negative pitch angle in the lift position is between about 15 and 25 degrees).

Notably, when the seat base bracket 34 rises from its original position atop the front base tube 16, the front casters 39 rise with the seat base bracket 34. As such, the front base tube 16 then rests on the underlying surface. This can provide a more stable foundation for an occupant exiting the chair 10. The front base tube 16 may include slides 16*a* to contact the underlying surface. In addition, the sole contacts points between the seat base bracket 34 and the base 12 are the rear cross tube 37 and the front lower edge 36; consequently, the chair 10 has minimal "pinch points." Moreover, in moving to the lift position the seat 30 moves slightly rearwardly relative to the base 12 to prevent tipping in the lift position.

Figure 8:
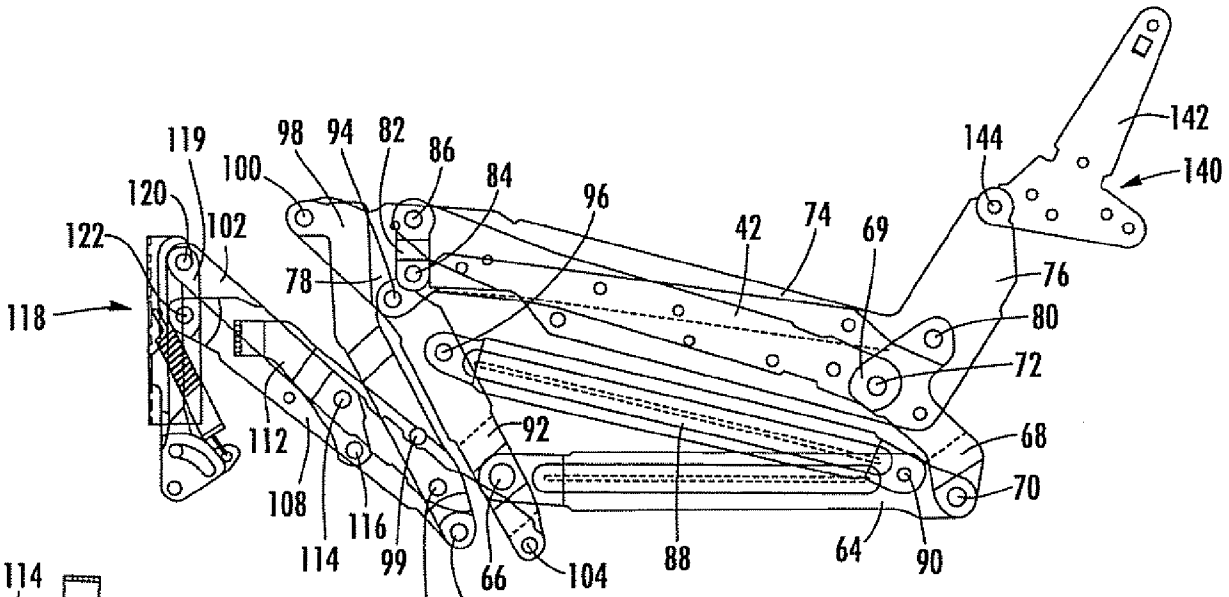
FIG. 8 is a side section view of the reclining mechanism of the chair of FIG. 1 shown in the upright position.

Turning now to FIGS. 2 and 8, the portions of the lift-reclining mechanism 24 that move the chair from the upright position to its TV position are described. In the interest of clarity, these portions of the lift-reclining mechanism 24 will be described in the upright position initially.

The lift-reclining mechanism 26 includes a slightly bent connecting link 64 that is attached at a pivot 66 to the lower end of the finger 59 of the transition member 58 and extends rearwardly therefrom. A generally L-shaped seat pitch crank 68 is pivotally interconnected at one end to the rearward end of the connecting link 64 at a pivot 70. The vertex 69 of the seat pitch crank 68 is pivotally attached to the rear end of the seat link 42 at a pivot 72. The seat pitch crank 68 is also attached to a seat plate 74 at a pivot 80. The seat plate 74 includes an upper protection 76 at its rear end (the pivot 80 is located at the base of the upper projection 76) and a lower projection 78 on a forward portion of its lower edge. A short toggle link 82 is attached to a forward portion of the seat plate 74 at a pivot 84 located on the rearward portion of the lower projection 78. The toggle link 82 extends upwardly from the pivot 84 to a pivot 86 with the forward end of the seat link 42.

Referring still to FIGS. 2 and 8, a straight ottoman drive link 88 is attached at its rear end at a pivot 90 to a slight rise in the connecting link 64 just forward from the pivot 70. The ottoman drive link 88 extends forwardly and upwardly from the pivot 90 to a pivot 96 with a lower ottoman swing link 92. The lower ottoman swing link 92 is attached at its rearward end to the lower projection 78 of the seat plate 74 at a pivot 94 and extends downwardly and rearwardly therefrom. Also, an upper ottoman swing link 98 is pivotally attached at a pivot 100 to the forward end of the seat plate 74 and extends generally parallel to the lower ottoman swing link 92. A pin 99 is attached and projects transversely from the upper ottoman swing link 98. An upper ottoman extension link 102 is attached to the lower end of the lower ottoman swing link 92 at a pivot 104 and to a lower portion of the upper ottoman swing link 98 at a pivot 106. The upper ottoman extension link 102 extends forwardly and upwardly to a pivot 120 with a base link 119 of a front ottoman assembly 118. A lower ottoman extension link 108 extends generally parallel to the upper ottoman extension link 102 from a pivot 110 with the lower end of the upper ottoman swing link 98 to a pivot 122 with the base link 119. An intermediate ottoman bracket 112 is attached at its lower end to the central portion of the lower ottoman extension link 108 at a pivot 116 and extends upward and forwardly through a pivot 114 with the upper ottoman extension link 102 to provide a vertical mounting location for the intermediate ottoman 29*b*.

Figure 10:
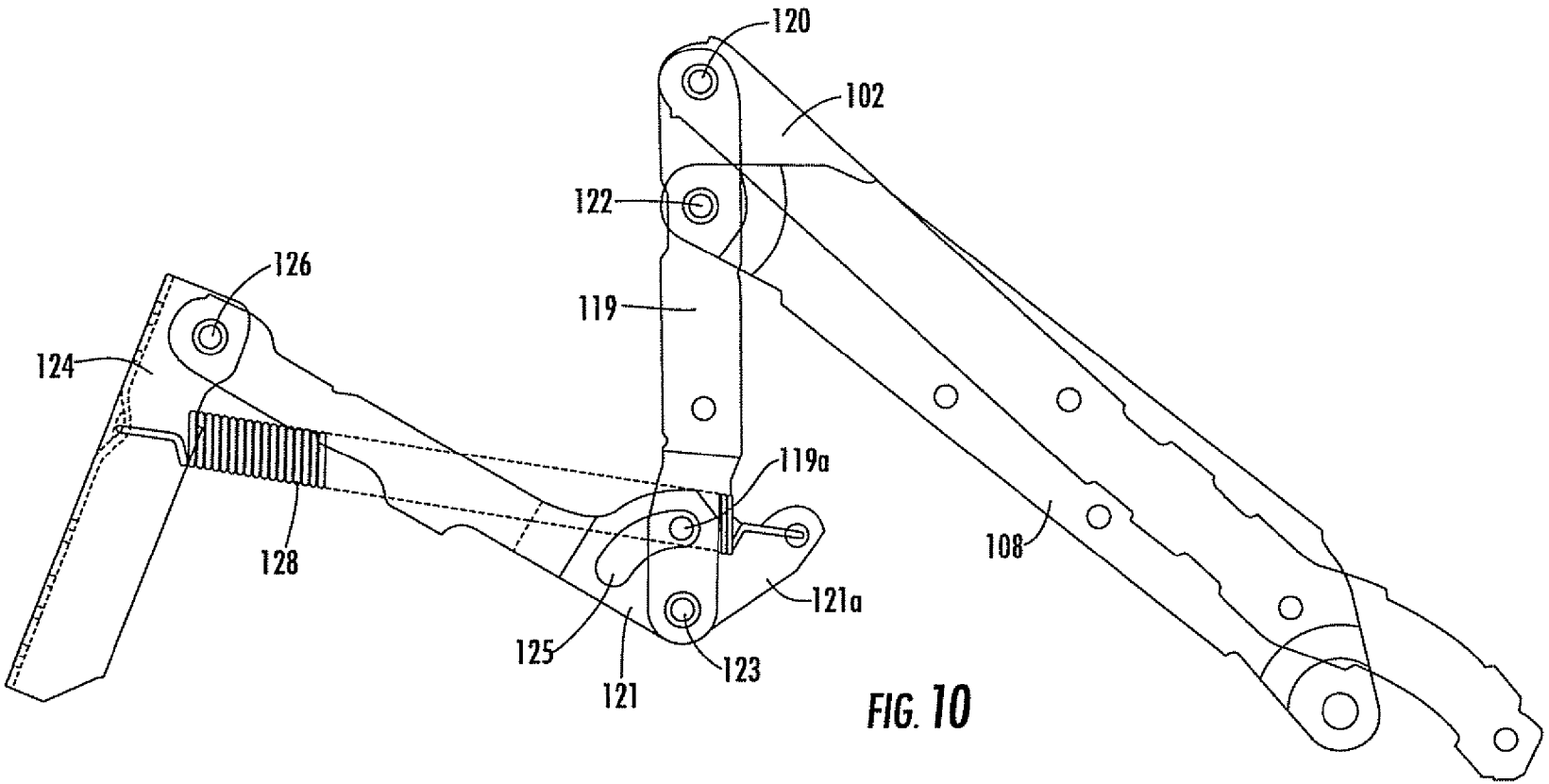
FIG. 10 is an enlarged side view of the footrest assembly of the chair of FIG. 1.

Referring now to FIGS. 8 and 10, the front ottoman assembly 118 includes the aforementioned base link 119, which extends downwardly beyond the pivot 122. A spring link 121 is attached to the lower end of the base link 119 at a pivot 123 and extends upwardly therefrom parallel to the base link 119. The spring link 121 includes a slot 125 toward its lower end that receives a pin 119*a* that projects from the base link 119. The spring link 121 also includes an extension 121*a* that extends upwardly and rearwardly from the pivot 123. A front ottoman bracket 124, to which the front ottoman 29*a* is mounted, is attached to the upper end of the spring link 121 at a pivot 126. The front ottoman bracket 124 is generally vertically disposed so that the front ottoman 29*a* can serve as the front panel of the chair 10. A spring 128 extends between the extension 121*a* and the front ottoman bracket 124 and is in tension to urge the spring link 121 to remain generally parallel to the front ottoman bracket 124.

Turning now to the backrest reclining mechanism 24 that moves the backrest 31 from an upright disposition in the TV position (FIGS. 3 and 9) to more reclined disposition in the fully reclined position (FIG. 4), a backpost assembly 140 includes a generally T-shaped backpost link 142 that is attached at one end to the upper projection 76 of the seat link 74 at a pivot 144. The backpost assembly 140 also includes a backpost bracket 146 that is fixed to the lower portion of the backpost link 142 and extends downwardly therefrom. A cross-member 148 extends between the lower ends of the backpost bracket 146 on opposite sides of the chair 10.

A backrest power unit 150 includes a motor 152 and a retractable rod 154. The motor 152 is fixed to a mounting bracket 153*a* which is, in turn, attached at a pivot 155 to a mounting bracket 153*b* that is fixed to the cross-member 35. The rear end of the rod 154 is attached via a pivot 156 to a mounting bracket 158 that is fixed to the cross-member 148 of the backpost assembly 140.

Figure 3:
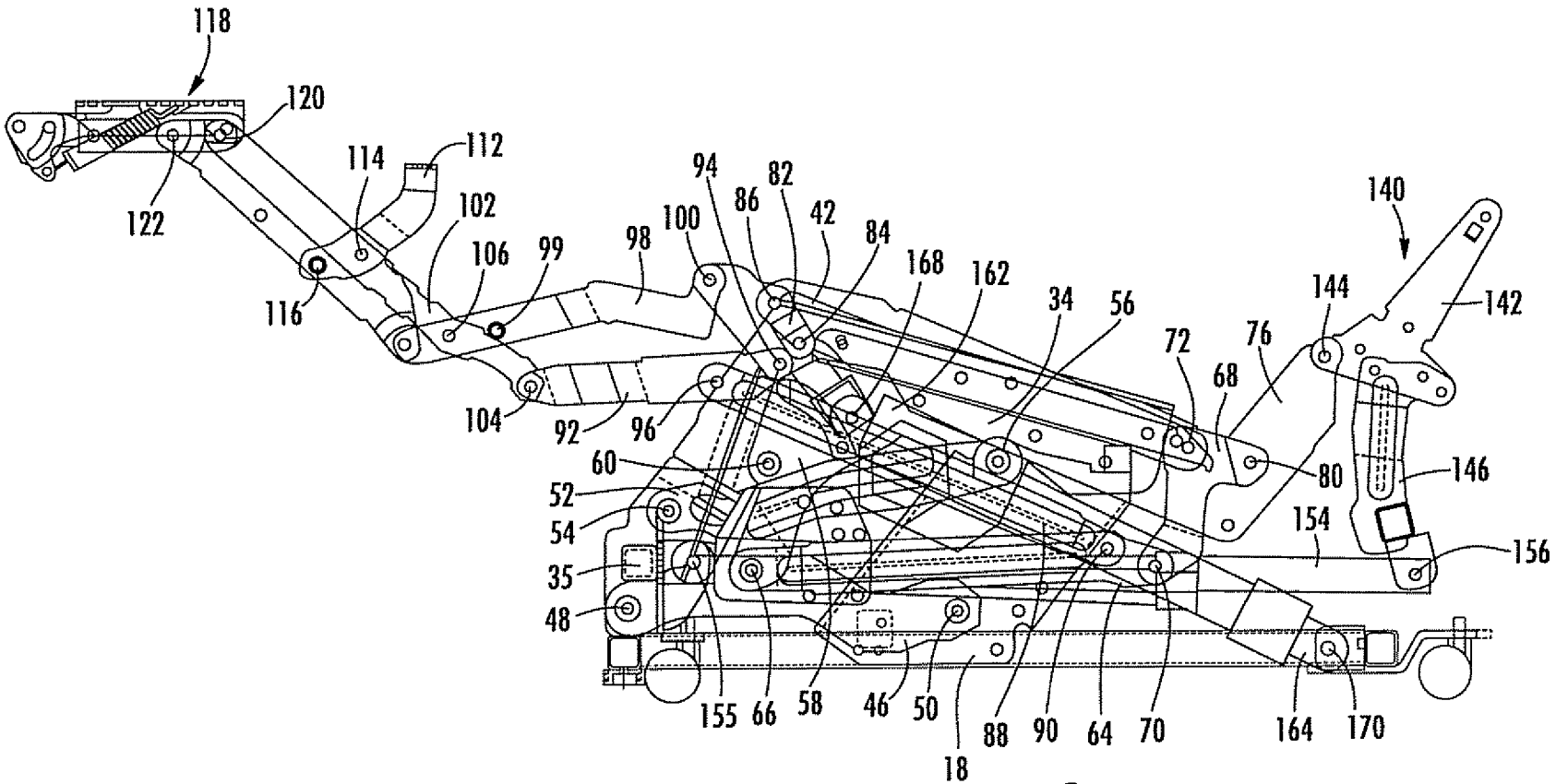
FIG. 3 is a side section view of the lift and reclining mechanisms of the chair of FIG. 1 shown in the TV position.
Figure 9:
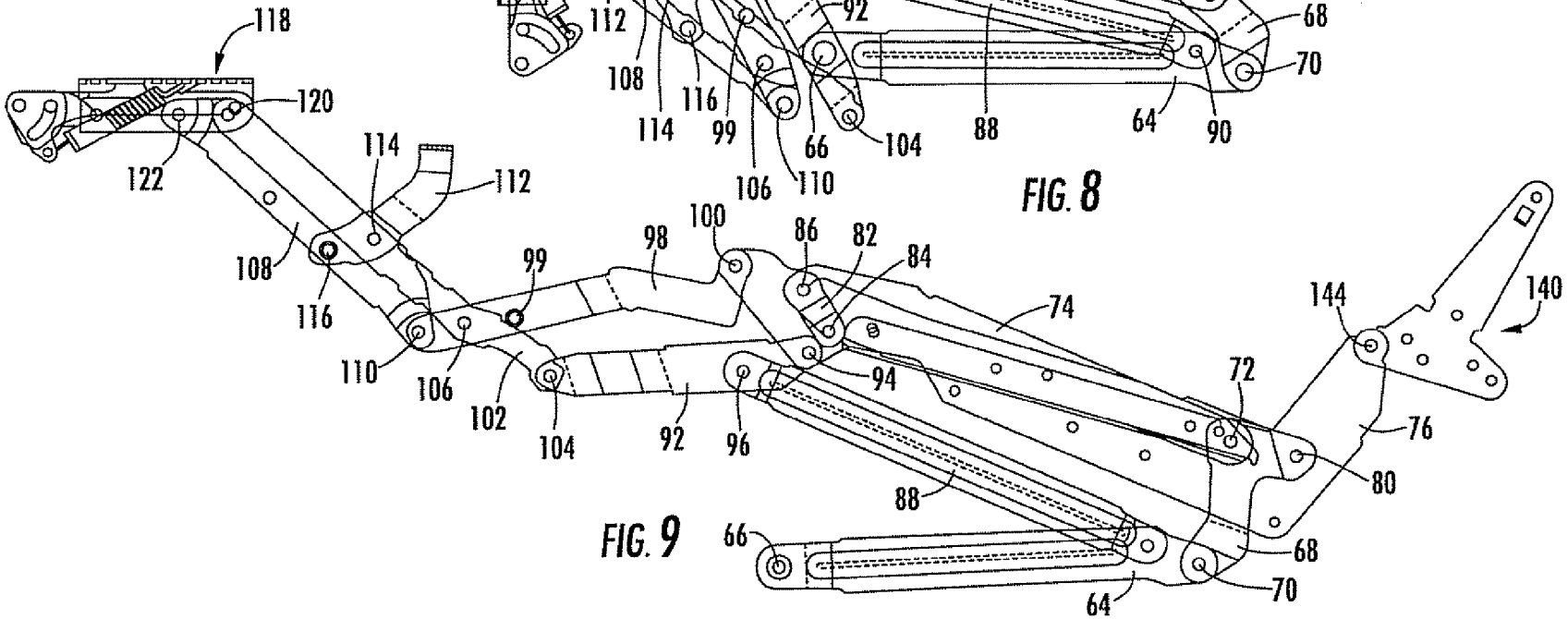
FIG. 9 is a side section view of the reclining mechanism of the chair of FIG. 1 shown in the TV position.

To move the chair 10 from the upright position of FIGS. 1, 2 and 8 to the TV position of FIGS. 3 and 9, the occupant of the chair 10 energizes the motor 162 of the motor unit 160 to cause the rod 164 to retract into the motor 162. This action draws the lobe 58*a* of transition member 58 rearwardly as it pivots clockwise about the pivot 60; the pin 62 moves within the slot 40 during this movement. As the finger 59 of the transition member 58 moves forward, it draws the connecting link 64 forward. The motion of the connecting link 64 draws the ottoman drive link 88 forward, which in turn drives the lower ottoman swing link 92 to rotate clockwise about the pivot 94. This action forces the upper ottoman extension link 98 forward, which in turn rotates the upper ottoman swing link 98 about the pivot 100. The forward movement of the upper ottoman swing link 98 drives the lower ottoman extension link 108 forwardly. In moving forward, the lower ottoman extension link 108 moves forward slightly more than the upper ottoman extension link 102, such that the front ottoman assembly 118 rotates clockwise approximately 90 degrees, as does the intermediate ottoman bracket 112. Movement of the lift-reclining mechanism 24 ceases when the pin 99 on the upper ottoman swing link 98 contacts the upper edge of the upper ottoman extension link 102 and when the pin 62 on the transition member 58 reaches the lower, rearward end of the slot 40 in the seat base bracket 34.

The movement of the chair 10 to the TV position not only has the effect of extending the front and intermediate ottomans, but also of increasing the pitch of the seat 30 relative to the underlying surface. This movement is controlled by the seat pitch crank 68, which rotates clockwise about the pivot 72 when the connecting link 64 draws the lower end of the seat pitch crank 68 forward. The action of the seat pitch crank 68 drives the rear end of the seat plate 74 downwardly and slightly rearwardly (the toggle link 82 also rotates counterclockwise about the pivot 84). In moving from the upright to the TV position, the angle of the seat 30 relative to the floor typically changes between about 5 and 15 degrees (in some embodiments, the seat 30 has a pitch angle of between about 5 and 10 degrees in the upright position and between about 12 and 20 degrees in the TV position).

The front ottoman assembly 118 is configured so that, if extreme force is applied to the front ottoman 29*a*, the bracket 124 will release and pivot counterclockwise about the pivot 123 (the movement is shown in FIG. 10). This action can prevent the chair 10 from tipping if, for example, a child jumps onto the front ottoman 29*a* when it is extended.

Figure 4:
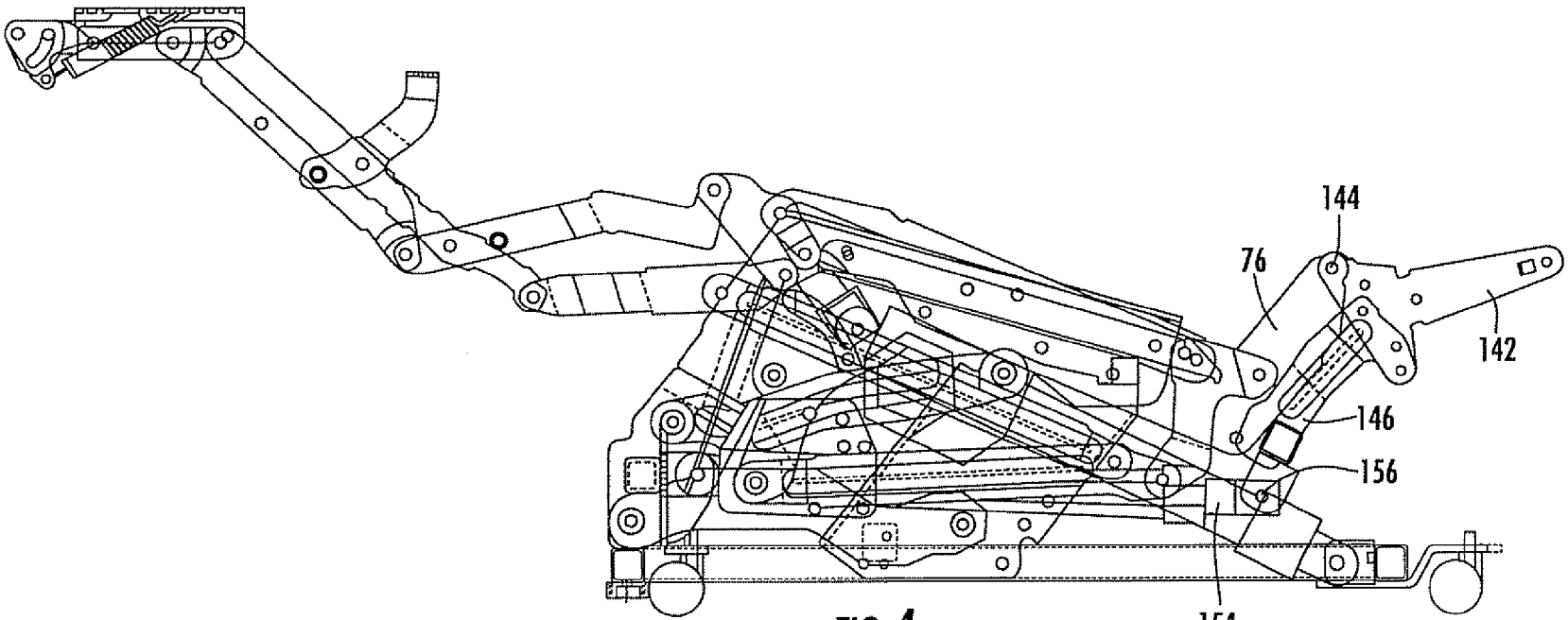
FIG. 4 is a side section view of the lift and reclining mechanisms of the chair of FIG. 1 shown in the fully reclined position.

An occupant can move the chair 10 from the TV position of FIGS. 3 and 9 to the fully reclined position of FIG. 4 by energizing the motor 152 of the motor unit 150 to retract the rod 154. Retraction of the rod 154 draws the lower end of the backpost bracket 146 forwardly, which causes the backpost link 142 (and, in turn, the backrest 31) to pivot clockwise about the pivot 144 so that the backrest 31 is reclined relative to the seat 30. The movement of the backrest 31 ceases when a rib 147 strikes the rear edge of the seat plate 74.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A lift chair, comprising:

a base;

a seat;

a backrest;

at least one ottoman;

a lift-reclining mechanism attached to the base and to the seat;

a backrest reclining mechanism coupled with the lift-reclining mechanism and attached to the seat, the backrest and the ottoman;

a lift power unit attached to the base and to the lift-reclining mechanism; and a backrest reclining power unit attached to the base and to the backrest reclining mechanism;

wherein the lift-reclining mechanism is configured to move the chair between an upright position, in which the seat is generally horizontally disposed and positioned above the base at a first height and at a first pitch angle that is positive relative to horizontal, the backrest is generally upright, and the ottoman is positioned below the seat, and a lifted position, in which the seat is raised to a second height that is higher than the first height and at a second pitch angle that is negative relative to horizontal;

wherein the lift-reclining mechanism is further configured to move the chair from the upright position to a TV position, in which the ottoman is generally horizontally disposed in front of the seat; and wherein the backrest reclining mechanism is configured to move the chair between the TV position and a fully reclined position, in which the backrest is reclined relative to the seat.

2. The lift chair defined in claim 1, wherein the backrest includes a backpost assembly that is fixed to the backrest, and wherein the backrest reclining mechanism is pivotally interconnected to the backpost assembly.

3. The lift chair defined in claim 1, wherein the base includes a fixed base bracket, and wherein the lift-reclining mechanism includes (a) upper and lower swing links that are pivotally interconnected with the base bracket and (b) a seat base bracket assembly fixed relative to the seat that is pivotally interconnected with the upper and lower swing links.

4. The lift chair defined in claim 3, wherein the seat base bracket assembly rests upon the base when the chair is in the upright position.

5. The lift chair defined in claim 4, wherein the seat base bracket assembly also rests on the base bracket when the chair is in the upright position.

6. The lift chair defined in claim 1, wherein a seat base bracket is fixed relative to the seat, and wherein an ottoman-extending linkage is pivotally interconnected with the seat base bracket and with the ottoman.

7. The lift chair defined in claim 6, wherein the lift-reclining mechanism includes a transition member that is pivotally attached to the seat base bracket, a connecting link that is pivotally attached to the transition member, and an ottoman drive link that is pivotally attached to the connecting link and to the ottoman-extending linkage.

8. The lift chair defined in claim 7, wherein the transition member has a pin that is received in a slot in the seat base bracket, and wherein the pin is located at one end of the slot when the chair is in the lift and upright positions and at the other end of the slot when the chair is in the TV and fully reclined positions.

9. The lift chair defined in claim 7, wherein the transition member is pivotally attached with the lift power unit.

10. The lift chair defined in claim 1, further including front and rear sets of wheels.

11. The lift chair defined in claim 10, wherein the lift-reclining mechanism includes a seat base bracket, and wherein the front wheels are attached to the seat base bracket, such that the front wheels are lifted from the ground when the chair moves to the lift position.

12. A lift chair, comprising:

a base;

a seat;

a backrest;

at least one ottoman;

a lift-reclining mechanism attached to the base and to the seat;

a backrest reclining mechanism coupled to the lift-reclining mechanism and attached to the seat, the backrest and the ottoman;

a lift power unit attached to the base and to the lift-reclining mechanism; and a backrest reclining power unit attached to the base and to the backrest reclining mechanism;

wherein the lift-reclining mechanism is configured to move the chair between an upright position, in which the seat is generally horizontally disposed and positioned above the base at a first height and at a first pitch angle that is positive relative to horizontal, the backrest is generally upright, and the ottoman is positioned below the seat, and a lifted position, in which the seat is raised to a second height that is higher than the first height and at a second pitch angle that is negative relative to horizontal;

wherein the lift-reclining mechanism is further configured to move the chair from the upright position to a TV position, in which the ottoman is generally horizontally disposed in front of the seat;

wherein the backrest reclining mechanism is configured to move the chair between the TV position and a fully reclined position, in which the backrest is reclined relative to the seat;

wherein the chair includes front and rear sets of wheels;

wherein the lift-reclining mechanism includes a seat base bracket fixed relative to the seat, and wherein the front wheels are attached to the seat base bracket, such that the front wheels are lifted from the ground when the chair moves to the lift position; and wherein the seat base bracket unit rests upon the base when the chair is in the upright position.

* * * * *